US009599115B2

(12) United States Patent
Chou et al.

(10) Patent No.: US 9,599,115 B2
(45) Date of Patent: Mar. 21, 2017

(54) SERIES FAN

(71) Applicant: Asia Vital Components Co., Ltd., New Taipei (TW)

(72) Inventors: Chu-Hsien Chou, New Taipei (TW); Shih-Chieh Lin, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 501 days.

(21) Appl. No.: 14/178,680

(22) Filed: Feb. 12, 2014

(65) Prior Publication Data

US 2015/0226222 A1 Aug. 13, 2015

(51) Int. Cl.
*F04D 19/00* (2006.01)
*F04D 29/38* (2006.01)

(52) U.S. Cl.
CPC ..... *F04D 19/007* (2013.01); *F04D 29/38* (2013.01); *F04D 29/384* (2013.01)

(58) Field of Classification Search
CPC ..... F04D 19/007; F04D 29/38; F04D 29/384
See application file for complete search history.

(56) References Cited

U.S. PATENT DOCUMENTS

| | | | | |
|---|---|---|---|---|
| 7,156,611 | B2 * | 1/2007 | Oosawa | F04D 19/007 415/199.5 |
| 7,168,912 | B2 * | 1/2007 | Sun | F04D 19/007 415/213.1 |
| 2008/0031722 | A1 * | 2/2008 | Yoshida | F04D 19/007 415/68 |
| 2009/0155104 | A1 * | 6/2009 | Takeshita | F04D 25/0613 417/423.5 |
| 2011/0070080 | A1 * | 3/2011 | Peng | F04D 19/007 415/214.1 |
| 2013/0051997 | A1 * | 2/2013 | Uchiyama | F04D 19/007 415/193 |

* cited by examiner

*Primary Examiner* — Jacob Cigna

(57) ABSTRACT

A series fan includes a first fan and a second fan. The first fan has a first frame, a second frame and a first flow passage. The second fan has a third frame, a fourth frame and a second flow passage. A first static blade is disposed at the first frame, while a second static blade is disposed at the fourth frame. A first dynamic blade assembly is disposed in the first flow passage, while a second dynamic blade assembly is disposed in the second flow passage. The second frame is assembled with the third frame. The first and second static blades serve to enhance the support strength and protection effect for the series fan. In addition, the first and second dynamic blade assemblies can be designed with an increased aerodynamic volume.

12 Claims, 4 Drawing Sheets

1

SERIES FAN

BACKGROUND OF THE INVENTION

1. Field of the Invention

The present invention relates generally to a series fan, and more particularly to a series fan having higher support strength and protection effect. Moreover, the dynamic blades can be designed with an increased aerodynamic volume.

2. Description of the Related Art

Along with the advance of sciences and technologies, the reliance of peoples on various electronic apparatuses has more and more increased. In operation, the internal components of the electronic products (such as computers and laptops) will generate high heat. The heat must be dissipated to outer side of the electronic products in time. Otherwise, the problem of overheating will take place. Therefore, most of the electronic products are provided with fans disposed therein for actively dissipating the heat and keeping the electronic products working at an operation temperature within a range. In some cases, the air volume provided by one single fan may be insufficient. Under such circumstance, two or more fans are often serially connected and assembled and co-used to provide sufficient air volume.

Please refer to FIG. 1. A conventional series fan 4 includes anterior dynamic blades 41, anterior static blades 42, posterior static blades 43 and posterior dynamic blades 44, which are sequentially arranged from air inlet to air outlet. The anterior static blades 42 and posterior static blades 43 are the main support members for the series fan 4. However, the anterior static blades 42 and posterior static blades 43 are disposed at the middle of the series fan 4. Therefore, the positions where the anterior dynamic blades 41 and the posterior dynamic blades 44 are positioned will have a relatively weak structural strength and support. That is, the structural support for the air inlet and air outlet of the series fan 4 is relatively weak. Moreover, in general, when the series fan 4 is fixed on an electronic device, the air inlet or the air outlet is assembled with the electronic device. The anterior dynamic blades 41 and the posterior dynamic blades 44 are positioned at the air inlet and the air outlet and have relatively weak structural support. Therefore, the total vibration value of the series fan 4 is increased. This will affect the systematic stability of the entire series fan. Also, the anterior dynamic blades 41 and the posterior dynamic blades 44 are positioned at the air inlet and the air outlet in an open state. In consideration of security, it is necessary to add protection screens to the air inlet and air outlet. Under such circumstance, the airflow is obstructed and the material cost is increased. Also, the working time is prolonged.

Furthermore, when the conventional series fan 4 is mounted in the electronic device, the assembling height is limited to a fixed height. Therefore, the total thickness of the series fan is also limited. However, the anterior static blades 42 and posterior static blades 43 are the main support members for the series fan 4. However, the anterior dynamic blades 41, the anterior static blades 42, the posterior static blades 43 and the posterior dynamic blades 44 are arranged in fixed positions. Therefore, the anterior static blades 42 and the posterior static blades 43 are located in fixed relationship to each other. In this case, the allowable arrangement thickness of the anterior dynamic blades 41 and the posterior dynamic blades 44 is limited. As a result, it is impossible to enhance the aerodynamic design of the anterior dynamic blades 41 and the posterior dynamic blades 44. According to the above, the conventional series fan has the following shortcomings:

1. The total vibration value is increased.
2. The material cost is increased and the working time is prolonged.
3. It is impossible to enhance the aerodynamic design of the anterior dynamic blades and the posterior dynamic blades.

SUMMARY OF THE INVENTION

It is therefore a primary object of the present invention to provide a series fan having higher support strength and protection effect.

It is a further object of the present invention to provide the above series fan, in which the dynamic blades can be designed with an increased aerodynamic volume To achieve the above and other objects, the series fan of the present invention includes a first fan and a second fan.

The first fan has a first frame, a second frame and a first flow passage. The first flow passage communicates with the first and second frames. A first static blade is disposed at the first frame. A first opening is formed at the second frame. A first dynamic blade assembly is disposed in the first flow passage in communication with the first opening.

The second fan has a third frame, a fourth frame and a second flow passage. The second flow passage communicates with the third and fourth frames. The third frame is assembled with the second frame. A second opening is formed at the third frame. The second opening communicates with the first opening. A second dynamic blade assembly is disposed in the second flow passage in communication with the second opening and in adjacency to the first dynamic blade assembly. A second static blade is disposed at the fourth frame. Accordingly, by means of the first static blade and the second static blade, the support strength and the protection effect for the series fan are enhanced. In addition, due to the communication between the first opening and the second opening, the first dynamic blade assembly and the second dynamic blade assembly can be designed with an increased aerodynamic volume.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
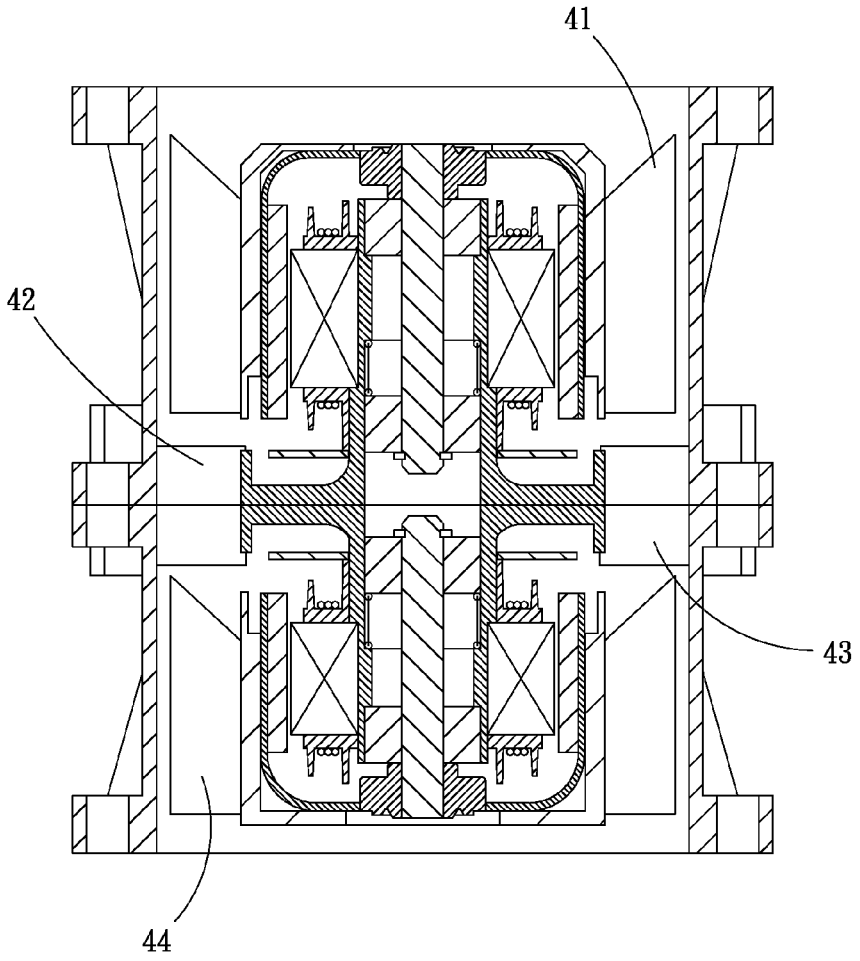
(PRIOR ART) Fig. 1
FIG. 1 is a sectional assembled view of a conventional series fan.
Figure 2:
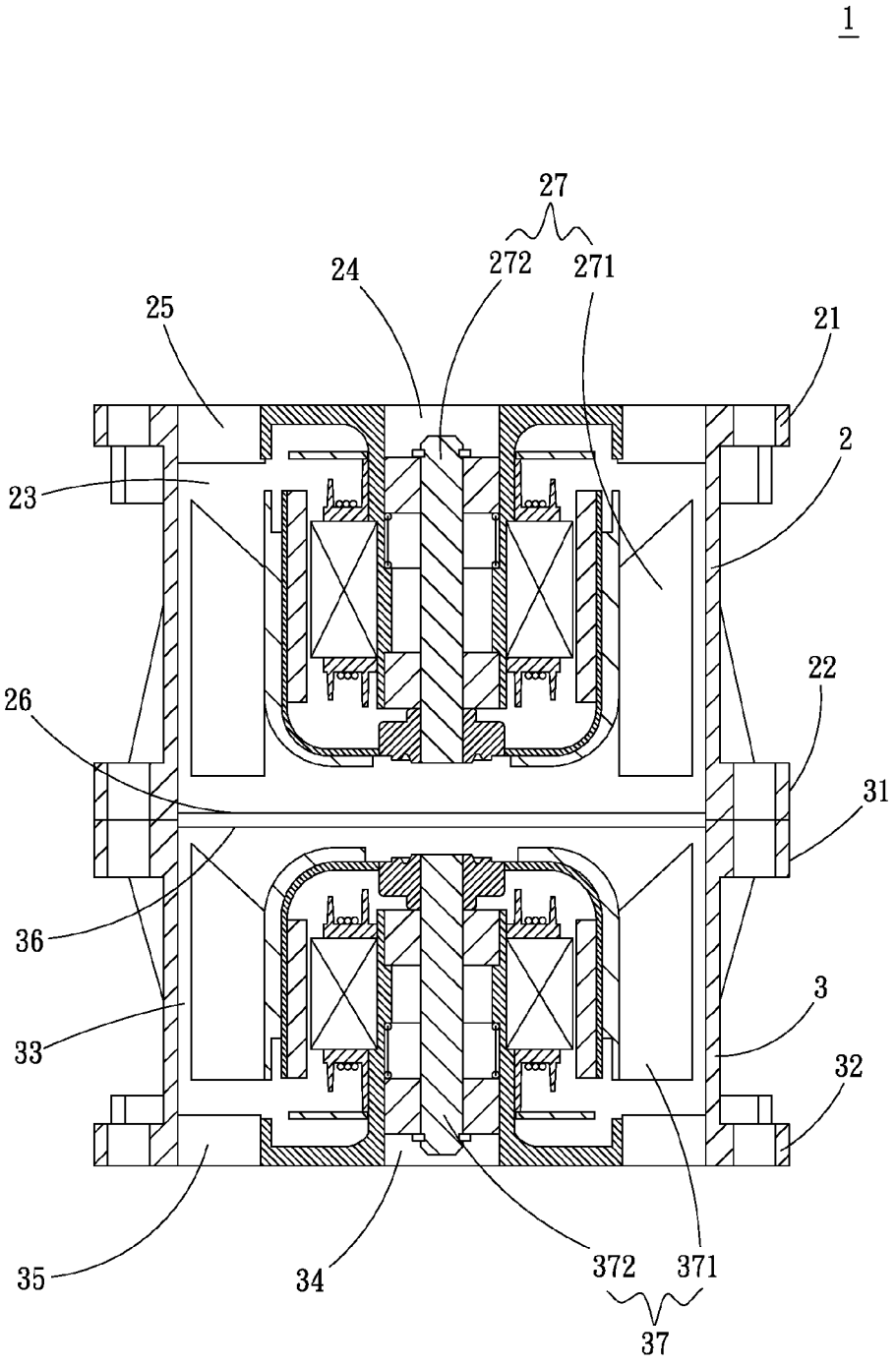
FIG. 2 is a sectional assembled view of a first embodiment of the present invention.

Please refer to FIG. 2, which is a sectional assembled view of a first embodiment of the series fan of present invention. According to the first embodiment, the series fan 1 of the present invention includes a first fan 2 and a second fan 3. The first fan 2 has a first frame 21 on one side and a second frame 22 on the other side. A first flow passage 23 is formed between the first and second frames 21, 22. The first flow passage 23 communicates with the first and second frames 21, 22. The first fan 2 further has a first base seat 24 and a first static blade 25. The first base seat 24 and the first static blade 25 are positioned at the first frame 21. In this embodiment, the first base seat 24 is disposed at the center of the first frame 21. The first static blade 25 is disposed between the first base seat 24 and the first frame 21. In this embodiment, the first frame 21 is the air inlet of the series fan 1. A first opening 26 is formed at the second frame 22. A first dynamic blade assembly 27 is disposed in the first flow passage 23 in communication with the first opening 26. The first dynamic blade assembly 27 has multiple first blades 271 and a first shaft 272. One end of the first shaft 272 is assembled with the first base seat 24.

The second fan 3 has a third frame 31 on one side and a fourth frame 32 on the other side. A second flow passage 33 is formed between the third and fourth frames 31, 32. The second flow passage 33 communicates with the third and fourth frames 31, 32. The second fan 3 further has a second base seat 34 and a second static blade 35. The second base seat 34 and the second static blade 35 are positioned at the fourth frame 32. In this embodiment, the second base seat 34 is disposed at the center of the fourth frame 32. The second static blade 35 is disposed between the second base seat 34 and the fourth frame 32. In this embodiment, the fourth frame 32 is the air outlet of the series fan 1. A second opening 36 is formed at the third frame 31. A second dynamic blade assembly 37 is disposed in the second flow passage 33 in communication with the second opening 36. The second dynamic blade assembly 37 has multiple second blades 371 and a second shaft 372. One end of the second shaft 372 is assembled with the second base seat 34.

In practice, the first and second static blades 25, 35 can be ribs. The static blades or ribs are fixedly disposed at the first frame 21 and the fourth frame 32 without rotation.

The first fan 2 and the second fan 3 are assembled and connected with each other to form the series fan 1. The second frame 22 of the first fan 2 is assembled and connected with the third frame 31 of the second fan 3. The third frame 31 is assembled with the second frame 22 by a means selected from a group consisting of engagement, locking, insertion, adhesion, latching and slide rail to achieve the object of serial connection of the first and second fans. The first opening 26 communicates with the second opening 36. The first dynamic blade assembly 27 is adjacent to the second dynamic blade assembly 37.

According to the above structural design, the first frame 21 of the series fan 1 is the air inlet, while the fourth frame 32 of the series fan 1 is the air outlet. Therefore, by means of the first static blade 25 and the second static blade 35, the support strength for the air inlet and air outlet of the series fan 1 is increased. In this case, the total vibration value of the series fan 1 will not increase.

Moreover, the first static blade 25 and the second static blade 35 provide a shielding and protection effect for the first dynamic blade assembly 27 and the second dynamic blade assembly 37. Under such circumstance, it is no more necessary to use any protection screen so that the material cost is lowered and the working time is shortened.

Figure 3:
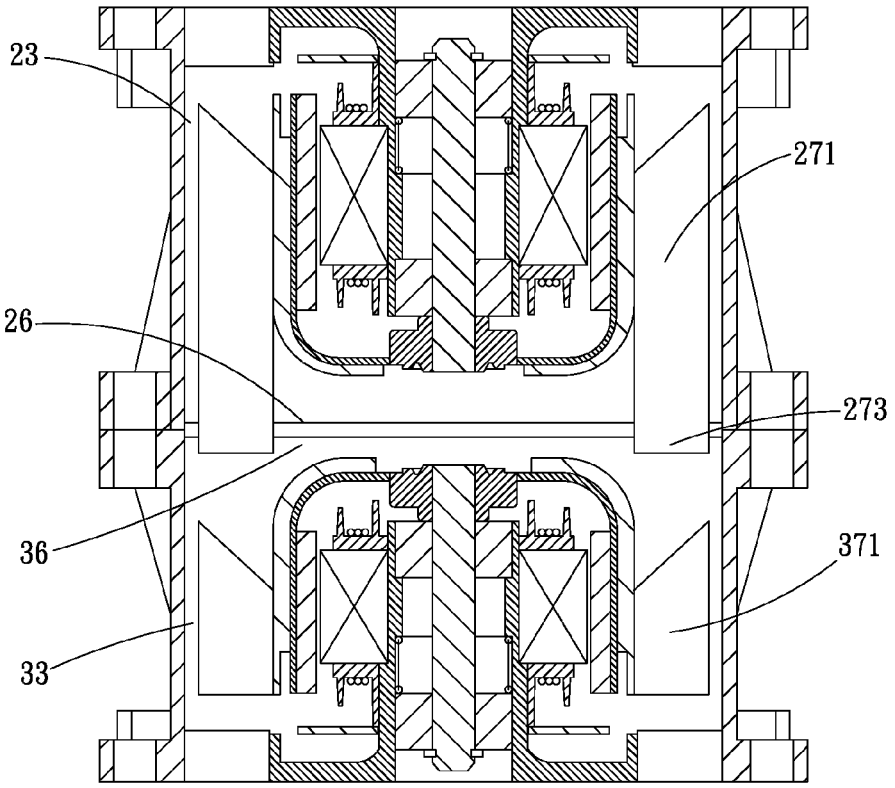
FIG. 3 is a sectional assembled view of a second embodiment of the present invention.

Please now refer to FIG. 3, which is a sectional assembled view of a second embodiment of the series fan of the present invention. The second embodiment is partially identical to the first embodiment in component and relationship between the components and thus will not be repeatedly described. The second embodiment is mainly different from the first embodiment in that in the second embodiment, the first blades 271 of the series fan 1 can be designed according to the required aerodynamic volume of the series fan 1. In the second embodiment, the first blades 271 communicate with the first opening 26 and extend to the second opening 36 and the second flow passage 33. In addition, the first blades 271 are spaced from the second blades 371 in the second flow passage 33 by a distance, whereby the first blades 271 and the second blades 371 can smoothly operate. According to such arrangement, when the series fan 1 is mounted in the electronic device, in the case that the assembling height is limited to a fixed height and the total thickness of the series fan 1 is limited, due to the communication between the first opening 26 and the second opening 36, the first blades 271 can be still designed with a required aerodynamic volume so as to enhance the aerodynamic effect of the series fan 1.

Figure 4:
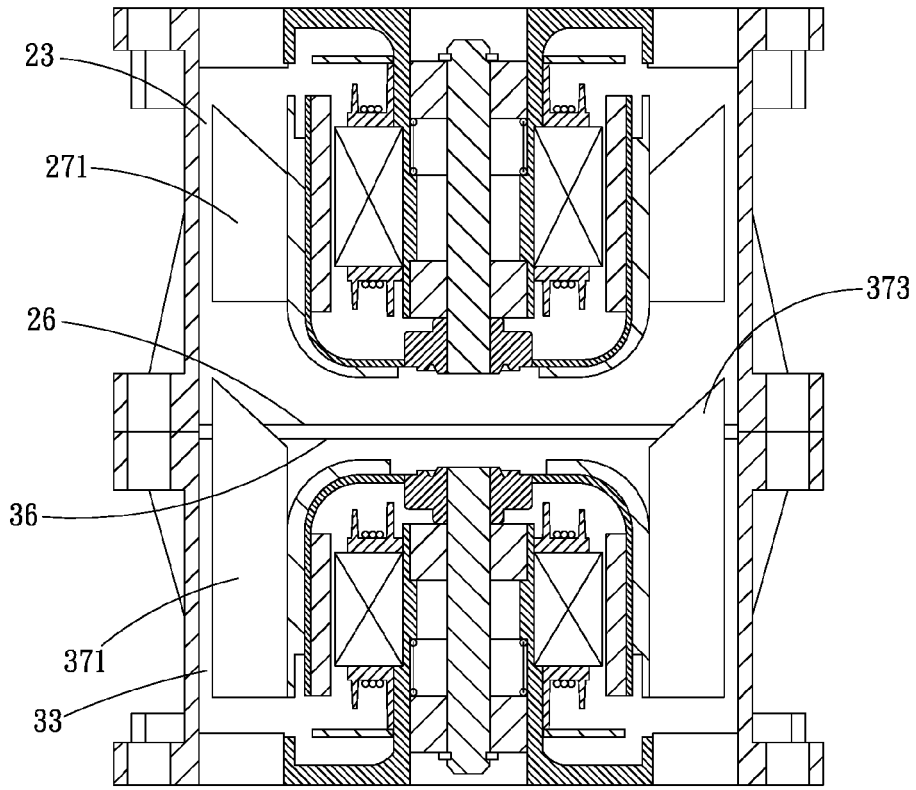
FIG. 4 is a sectional assembled view of a third embodiment of the present invention.

Please now refer to FIG. 4, which is a sectional assembled view of a third embodiment of the series fan of the present invention. The third embodiment is partially identical to the first embodiment in component and relationship between the components and thus will not be repeatedly described. The third embodiment is mainly different from the first embodiment in that in the third embodiment, the second blades 371 communicate with the second opening 36 and extend to the first opening 26 and the first flow passage 23. In addition, the second blades 371 are spaced from the first blades 271 in the first flow passage 23 by a distance, whereby the first blades 271 and the second blades 371 can smoothly operate. According to such arrangement, when the series fan 1 is mounted in the electronic device, in the case that the assembling height is limited to a fixed height and the total thickness of the series fan 1 is limited, due to the communication between the first opening 26 and the second opening 36, the second blades 371 can be still designed with a required aerodynamic volume so as to enhance the aerodynamic effect of the series fan 1.

In conclusion, in comparison with the conventional series fan, the present invention has the following advantages:

1. The total vibration value of the series fan will not increase.
2. The cost for the protection screens is saved and the working time is shortened.
3. The dynamic blades can be designed with a required aerodynamic volume.

The present invention has been described with the above embodiments thereof and it is understood that many changes and modifications in the above embodiments can be carried out without departing from the scope and the spirit of the invention that is intended to be limited only by the appended claims.

What is claimed is:

1. A series fan comprising:

a first fan having a first frame, a second frame and a first flow passage, the first flow passage communicating with the first and second frames, a first static blade being disposed at the first frame, a first opening being formed at the second frame, a first dynamic blade assembly being disposed in the first flow passage in communication with the first opening; and a second fan having a third frame, a fourth frame and a second flow passage, the second flow passage communicating with the third and fourth frames, the third frame being assembled with the second frame, a second opening being formed at the third frame, the second opening communicating with the first opening, a second dynamic blade assembly being disposed in the second flow passage in communication with the second opening and in adjacency to the first dynamic blade assembly, a second static blade being disposed at the fourth frame;

wherein the first dynamic blade assembly includes multiple first blades, while the second dynamic blade assembly includes multiple second blades;

wherein the multiple first blades are spaced from the multiple second blades in the second flow passage by a distance; and wherein each of the multiple first blades has an extension portion extending from the first flow passage through the first opening and the second opening to the second flow passage.

2. The series fan as claimed in claim 1, wherein the third frame is assembled with the second frame by a means selected from a group consisting of engagement, locking, insertion, adhesion, latching and slide rail.

3. The series fan as claimed in claim 1, wherein the first fan further has a first base seat, the first base seat being positioned at the first frame, the first static blade being disposed between the first base seat and the first frame.

4. The series fan as claimed in claim 3, wherein the first dynamic blade assembly further has a first shaft, one end of the first shaft being assembled with the first base seat.

5. The series fan as claimed in claim 1, wherein the second fan further has a second base seat, the second base seat being positioned at the fourth frame, the second static blade being disposed between the second base scat and the fourth frame.

6. The series fan as claimed in claim 5, wherein the second dynamic blade assembly further has a second shaft, one end of the second shaft being assembled with the second base seat.

7. A series fan comprising:

a first fan having a first frame, a second frame and a first flow passage, the first flow passage communicating with the first and second frames, a first static blade being disposed at the first frame, a first opening being formed at the second frame, a first dynamic blade assembly being disposed in the first flow passage in communication with the first opening; and a second fan having a third frame, a fourth frame and a second flow passage, the second flow passage communicating with the third and fourth frames, the third frame being assembly with the second frame, a second opening being formed at the third frame, the second opening communicating with the first opening, a second dynamic blade assembly being disposed in the second flow passage in communication with the second opening and in adjacency to the first dynamic blade assembly, a second static blade being disposed at the fourth frame;

wherein the first dynamic blade assembly includes multiple first blades, while the second dynamic blade assembly includes multiple second blades;

wherein the multiple first blades are spaced from the multiple second blades in the second flow passage by a distance; and wherein each of the multiple second blades has an extension portion extending from the second flow passage through the second opening and the first opening to the first flow passage.

8. The series fan as claimed in claim 7, wherein the third frame is assembled with the second frame by a means selected from a group consisting of engagement, locking, insertion, adhesion, latching and slide rail.

9. The series fan as claimed in claim 7, wherein the first fan further has a first base seat, the first base seat being positioned at the first frame, the first static blade being disposed between the first base seat and the first frame.

10. The series fan as claimed in claim 9, wherein the first dynamic blade assembly further has a first shaft, one end of the first shaft being assembled with the first base seat.

11. The series fan as claimed in claim 7, wherein the second fan further has a second base seat, the second base seat being positioned at the fourth frame, the second static blade being disposed between the second base seat and the fourth frame.

12. The series fan as claimed in claim 11, wherein the second dynamic blade assembly further has a second shaft, one end of the shaft being assembled with the second base seat.

* * * * *